US007487787B2

(12) United States Patent
Tung

(10) Patent No.: US 7,487,787 B2
(45) Date of Patent: Feb. 10, 2009

(54) EASY-TO-OPERATE SUNSHADE

(76) Inventor: Pai Tung, No. 2, Cheng Shing Rd., San Min, Kaohsiung (TW)

( * ) Notice: Subject to any disclaimer, the term of this patent is extended or adjusted under 35 U.S.C. 154(b) by 267 days.

(21) Appl. No.: 11/465,245

(22) Filed: Aug. 17, 2006

(65) Prior Publication Data

US 2008/0041431 A1 Feb. 21, 2008

(51) Int. Cl.
*A45B 11/00* (2006.01)
*A45B 25/14* (2006.01)

(52) U.S. Cl. ..... 135/21; 135/20.3; 135/98; 135/90; 248/317; 248/219.2; 248/283.1

(58) Field of Classification Search ..... 135/20.1, 135/20.3, 21, 90, 98; 248/371, 317, 218.4, 248/219.2, 228.3, 283.1
See application file for complete search history.

(56) References Cited

U.S. PATENT DOCUMENTS

| | | | | |
|---|---|---|---|---|
| 4,449,542 | A | 5/1984 | McSwain et al. | |
| 5,002,081 | A | 3/1991 | Stromeyer | |
| 5,116,258 | A | 5/1992 | Vennik | |
| 5,261,435 | A | 11/1993 | Stanley et al. | |
| 5,387,048 | A | 2/1995 | Kuo | |
| 5,499,644 | A | 3/1996 | Geniele | |
| 5,611,364 | A | 3/1997 | Woods et al. | |
| 5,678,585 | A | 10/1997 | May | |
| 5,735,302 | A | 4/1998 | Saliva | |
| 5,785,069 | A | 7/1998 | Glatz | |
| 5,845,665 | A | 12/1998 | Koehn | |
| 5,937,881 | A | 8/1999 | Villa | |
| 5,937,882 | A | 8/1999 | Harbaugh | |
| 6,014,980 | A | 1/2000 | Glatz | |
| 6,105,594 | A | 8/2000 | Diaz | |
| 6,152,156 | A | 11/2000 | Tung | |
| 6,220,261 | B1 | 4/2001 | Glatz | |
| 6,244,286 | B1 | 6/2001 | Russo | |
| 6,321,763 | B1 | 11/2001 | Ma | |
| 6,478,037 | B2 | 11/2002 | Tung | |
| 6,662,815 | B2 | 12/2003 | Tung | |
| 6,948,878 | B1 * | 9/2005 | Smith et al. | 403/110 |

FOREIGN PATENT DOCUMENTS

| | | | |
|---|---|---|---|
| EP | 1550383 | A1 * | 7/2005 |
| JP | 02034103 | A * | 2/1990 |

* cited by examiner

*Primary Examiner*—Winnie Yip
(74) *Attorney, Agent, or Firm*—Alan Kamrath; Kamrath & Associates PA

(57) ABSTRACT

A sunshade includes a supporting rod, a holding sleeve pivotably mounted to an upper end of the supporting rod, an arcuate tube slidably extended through the holding sleeve and including an end for coupling with a canopy support frame, a reel mounted to the other end of the arcuate tube, a mounting member mounted to the supporting rod, a quick release mounted around the other end of the arcuate tube, and a connecting rod including a first end pivotally connected to the mounting member and a second end pivotally connected to the quick release. When the quick release is in a clamping position, the quick release is fixedly clamped on the arcuate tube, and the other end of the arcuate tube is supported by the connecting rod. When the quick release is in a released position, relative sliding movement between the quick release and the arcuate tube is allowed.

13 Claims, 9 Drawing Sheets

EASY-TO-OPERATE SUNSHADE

BACKGROUND OF THE INVENTION

1. Field of the Invention

The present invention relates to a sunshade. More particularly, the present invention relates to a sunshade having an arcuate tube that is moved during folding/unfolding operation of the sunshade.

2. Description of the Related Art

U.S. Pat. No. 6,152,156 discloses a sunshade including a supporting rod, a canopy support frame, and a canopy. An adjusting sleeve is slidably mounted around the supporting rod. A holding sleeve is pivotally connected to an upper end of the supporting rod. An arcuate tube is slidably extended through the holding sleeve. An elbow is mounted to an end of the arcuate tube, and a reel is mounted to the other end of the arcuate tube. A connecting rod is connected between the other end of the arcuate tube and the adjusting sleeve. An anchor is releasably engaged in an anchor room in the elbow to relatively retain the canopy support frame in a desired tilting angle relative to the supporting rod. A cable is mounted between a handle of the reel and the anchor. The canopy is unfolded when the handle is operated to move the cable in a retracting direction. On the other hand, the canopy is folded when the handle is operated to move the cable in a releasing direction. The canopy can be moved to a desired tilting angle through operation of the adjusting sleeve, the arcuate tube, and the connecting rod.

When the canopy is folded, the sunshade can be further collapsed for easy storage and transportation by moving the arcuate tube to a fully folded position. However, the arcuate tube must be manually moved during the operation. More specifically, for moving the arcuate tube to the fully folded position or for moving the arcuate tube from the fully folded position to an unfolded position, both hands of the user must respectively hold and simultaneously apply forces to the arcuate tube and the adjusting sleeve, which is inconvenient to the user.

BRIEF SUMMARY OF THE INVENTION

In accordance with an aspect of the present invention, a sunshade comprises a supporting rod, a holding sleeve pivotably mounted to an upper end of the supporting rod, an arcuate tube slidably extended through the holding sleeve and including a first end adapted for coupling with a canopy support frame and a second end, a reel mounted to the second end of the arcuate tube, a first connecting member mounted to the supporting rod, a second connecting member, and a connecting rod.

The second connecting member includes a body mounted around the second end of the arcuate tube. The second connecting member further includes a lever pivotally coupled to the body. The lever is movable between a clamping position and a released position. The connecting rod includes a first end pivotally connected to the first connecting member and a second end pivotally connected to the second connecting member. A positioning member is releasably engaged with the first connecting member for positioning the connecting rod in place. The connecting rod is pivotable relative to the first connecting member when the positioning member is disengaged from the first connecting member.

When the lever is in the clamping position, the second connecting member is fixed on the arcuate tube, and the second end of the arcuate tube is supported by the connecting rod. When the lever is in the released position, relative sliding movement between the second connecting member and the arcuate tube is allowed.

When a canopy of the sunshade is folded, to further collapse the sunshade, the positioning member is disengaged from the first connecting member, and the lever is pivoted to the released position. A user may hold the reel with only one hand and pull the arcuate tube downward. The arcuate tube will slide downward to a fully folded position, allowing easy carriage and transportation of the sunshade. Unfolding of the sunshade can be achieved through reverse operation. An easy-to-operate sunshade is, thus, provided.

In an example, the sunshade includes a mounting sleeve mounted around the supporting rod, and the first connecting member extends from the mounting sleeve. The first connecting member includes a slot for pivotally receiving the first end of the connecting rod.

Preferably, the positioning member is a sleeve slidably mounted on the connecting rod between a first position engaged with the first connecting member and a second position disengaged from the first connecting member.

In an example, the second connecting member includes two ears between which the second end of the connecting rod is pivotally mounted. The body is substantially C-shaped and includes a slit. The body further includes two spaced lugs. The lever includes a screw pivotally connected to an end thereof. The screw extends through the lugs, allowing the lever to pivot between the clamping position and the released position.

Preferably, the reel includes a gripping handle.

Preferably, the reel includes a projection. A coupling member is mounted to the supporting rod and includes a notch for releasably engaging with the projection when the arcuate tube is moved to the fully folded position.

In an example, the coupling member is a ring mounted around the supporting rod and includes a protrusion in which the notch is defined.

In accordance with a second aspect of the present invention, a sunshade comprises a supporting rod, a holding sleeve pivotably mounted to an upper end of the supporting rod, an arcuate tube slidably extended through the holding sleeve and including a first end adapted for coupling with a canopy support frame and a second end, a reel mounted to the second end of the arcuate tube, a mounting member mounted to the supporting rod, a quick release mounted around the second end of the arcuate tube, and a connecting rod including a first end pivotally connected to the mounting member and a second end pivotally connected to the quick release.

When the quick release is in a clamping position, the quick release is fixedly clamped on the arcuate tube, and the second end of the arcuate tube is supported by the connecting rod. When the quick release is in a released position, relative sliding movement between the quick release and the arcuate tube is allowed.

Preferably, a positioning member is releasably engaged with the mounting member for positioning the connecting rod in place. The connecting rod is pivotable relative to the mounting member when the positioning member is disengaged from the mounting member.

Preferably, the positioning member is slidably mounted on the connecting rod between a first position engaged with the mounting member and a second position disengaged from the mounting member.

Other objectives, advantages, and novel features of the invention will become more apparent from the following detailed description when taken in conjunction with the accompanying drawings.

DETAILED DESCRIPTION OF THE INVENTION

Figure 1:
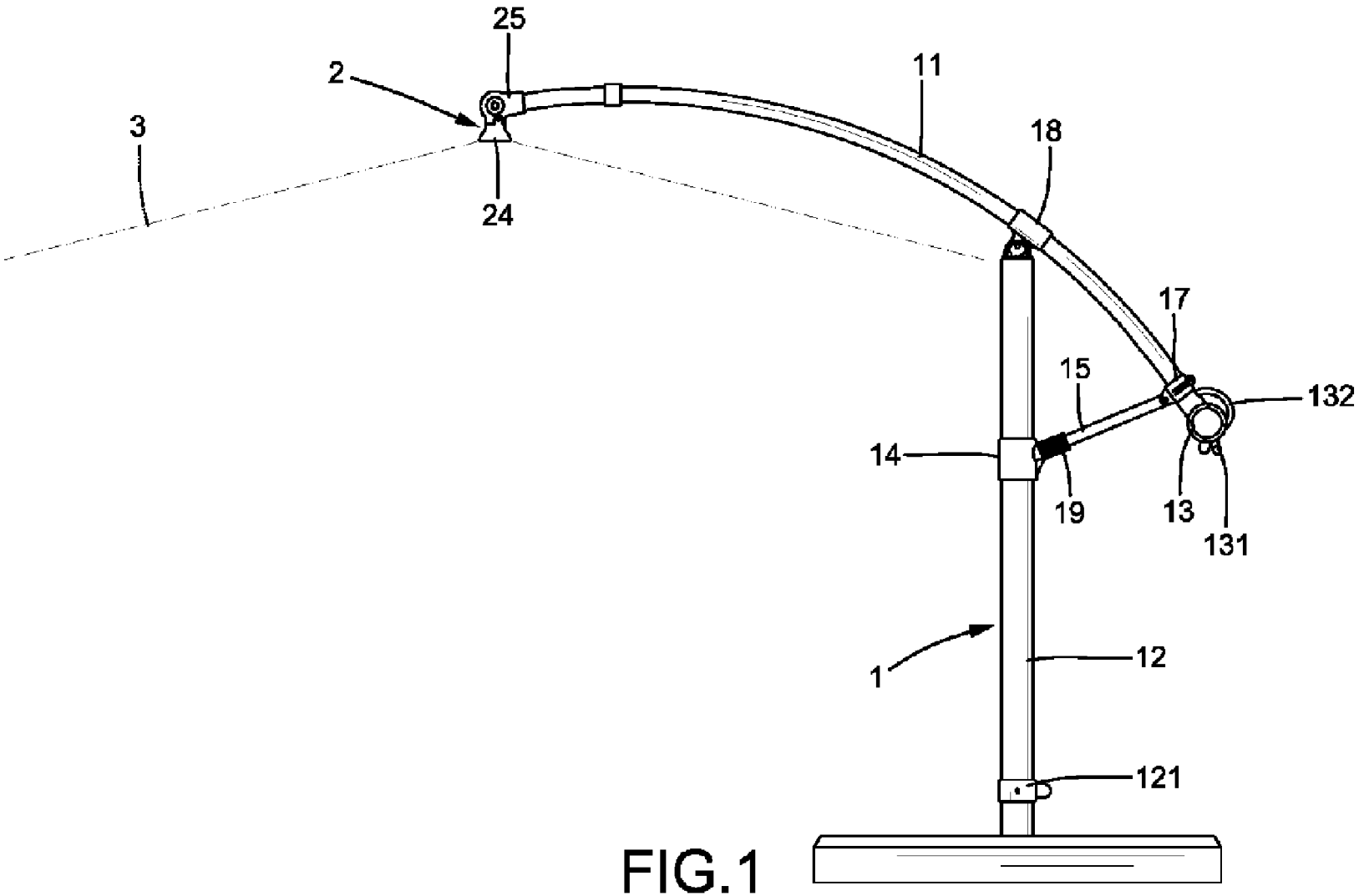
FIG. 1 is a side view of a sunshade in accordance with the present invention, wherein a canopy is unfolded.

Referring to FIG. 1, a sunshade in accordance with the present invention comprises a main frame 1 and a canopy support frame 2 to which a canopy 3 is mounted. The main frame 1 includes a supporting rod 12 around which a mounting sleeve 14 is mounted. A holding sleeve 18 is pivotably mounted to an upper end of the supporting rod 12. An arcuate tube 11 is slidably extended through the holding sleeve 18 and includes an elbow 25 mounted to a first end thereof and a reel 13 mounted to a second end thereof.

The canopy support frame 2 includes a suspension member 24 coupled to the elbow 25. An example of the canopy support frame 2 is disclosed in Applicant's U.S. Pat. No. 6,152,156 to allow folding/unfolding operation of the canopy 3. The entire content of U.S. Pat. No. 6,152,156 is incorporated herein by reference. Nevertheless, other canopy support frames allowing folding/unfolding operation of the canopy 3 can be used.

Figure 2:
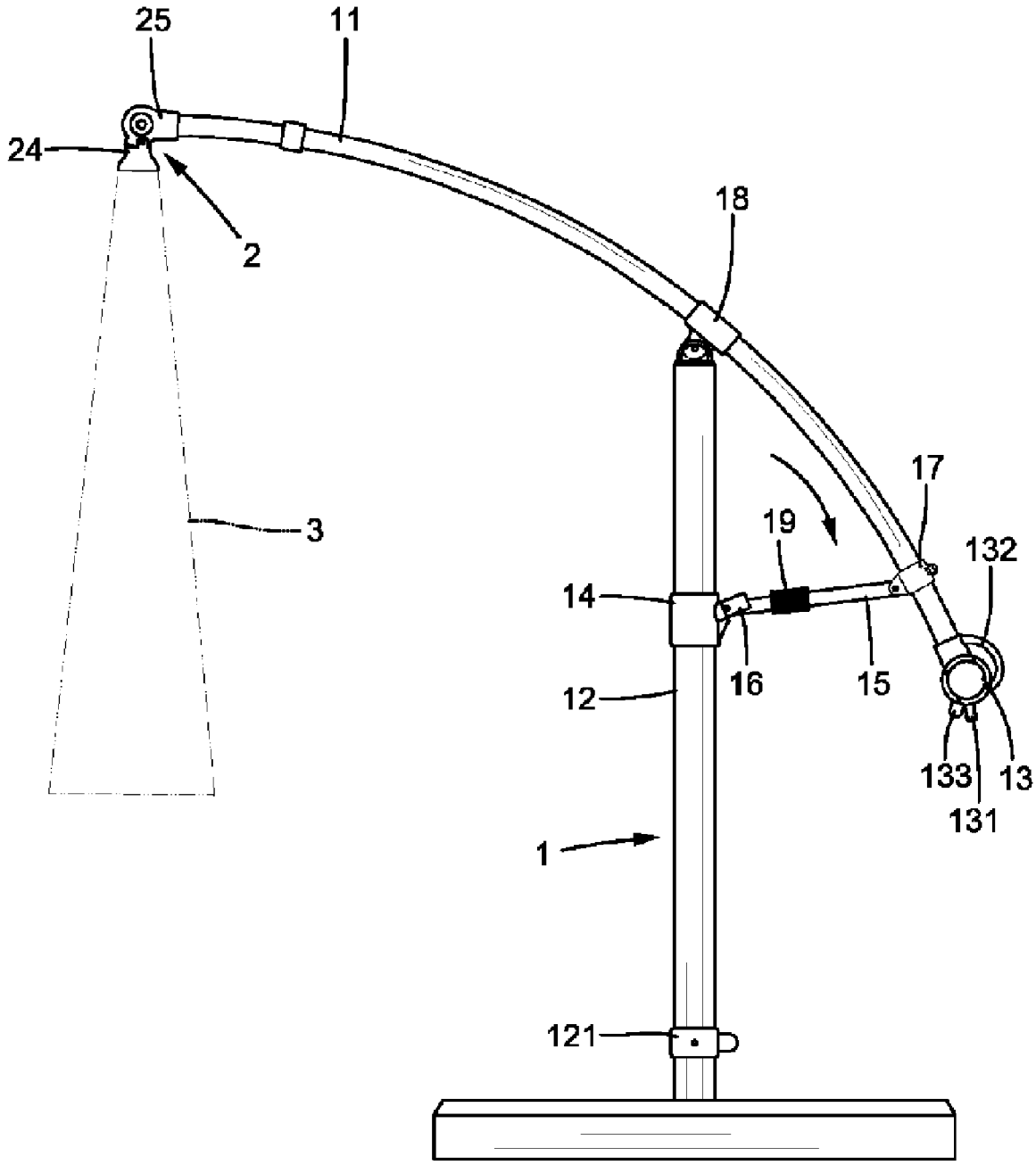
FIG. 2 is a view similar to FIG. 1, wherein the canopy is folded.

A cable (not shown) includes an end attached to and operable by a handle 131 of the reel 13 so as to be movable in a retracting direction and a releasing direction. The other end of the cable is coupled to the canopy support frame 2 for folding (or unfolding) the canopy 3 (see FIGS. 1 and 2) when the cable moves in the retracting (or releasing) direction, which is conventional.

Figure 3:
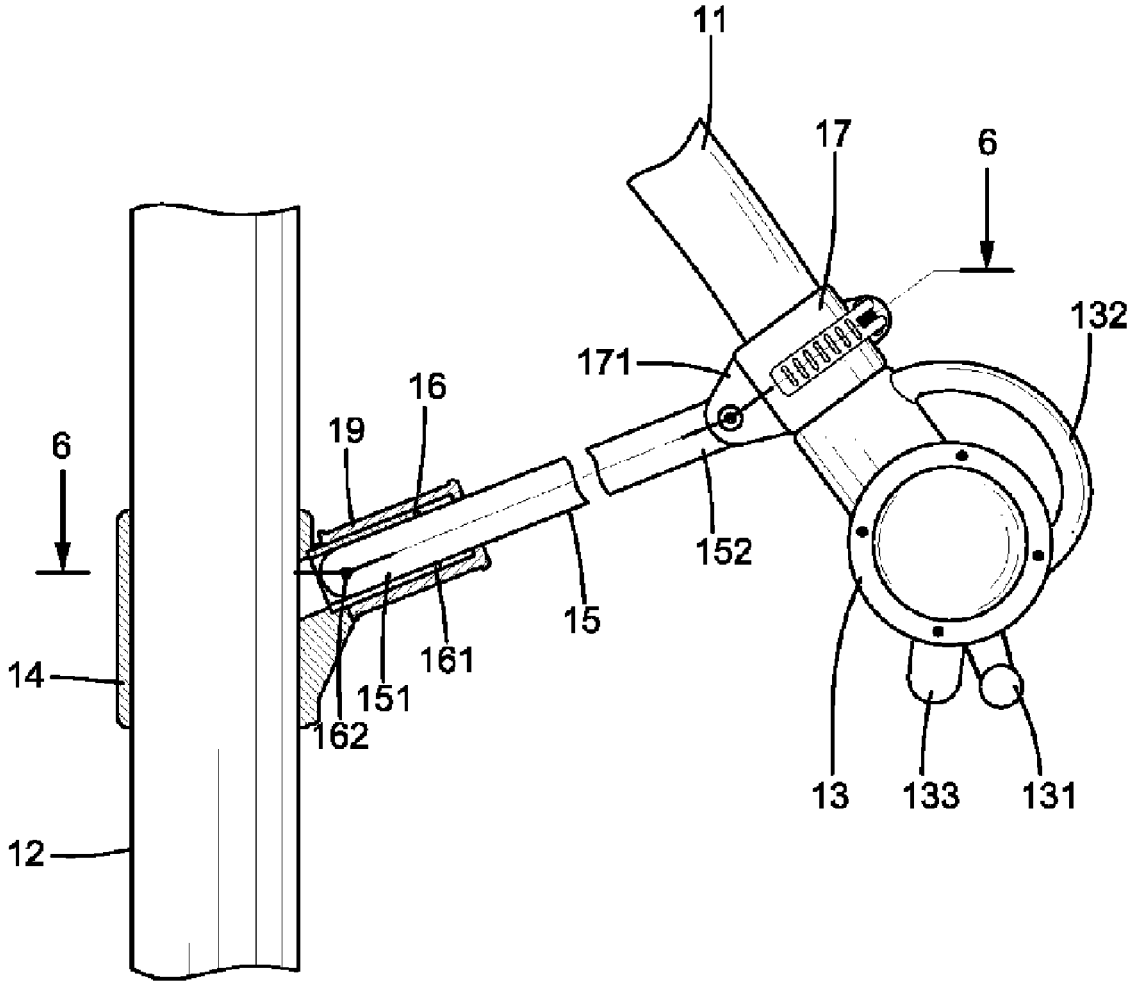
FIG. 3 is an enlarged view, partially sectioned, of a portion of the sunshade in FIG. 1, illustrating a first connecting member and a mounting sleeve.
Figure 4:
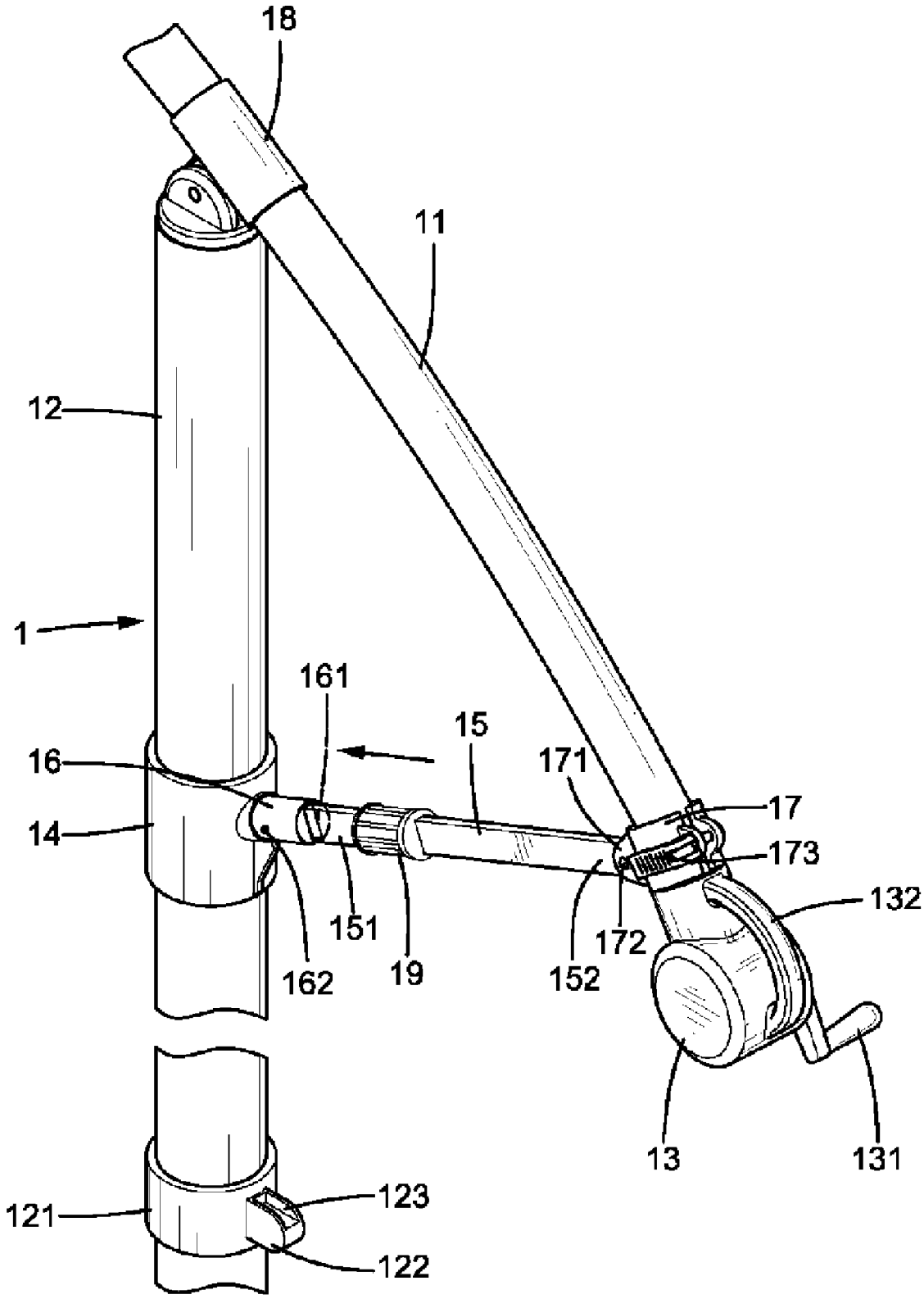
FIG. 4 is an enlarged perspective view of a portion of the sunshade in FIG. 1, illustrating a positioning member in a state disengaged from the first connecting member.

Referring to FIGS. 3 and 4, a connecting rod 15 is mounted between the supporting rod 12 and the second end of the arcuate tube 11. A first connecting member 16 extends outward and upward from the mounting sleeve 14 and includes a slot 161 in which a first end 151 of the connecting rod 15 is received. The first end 151 of the connecting rod 15 is pivoted by a pin 162 to the first connecting member 16, allowing the first end 151 of the connecting rod 15 to be pivotable between a first position (see FIG. 3) in the slot 161 of the first connecting member 16 and a second position (see FIG. 8) outside the first connecting member 16. A positioning member 19 (in the form of a sleeve in this example) is slidably mounted on the connecting rod 15 and movable between a first position engaged with the first connecting member 16 (see FIGS. 3 and 6) for retaining the first end 151 of the connecting rod 15 in the slot 161 of the first connecting member 16 and a second position disengaged from the first connecting member 16 (see FIGS. 4 and 7), allowing pivotal movement of the connecting rod 15 relative to the first connecting member 16.

Figure 5:
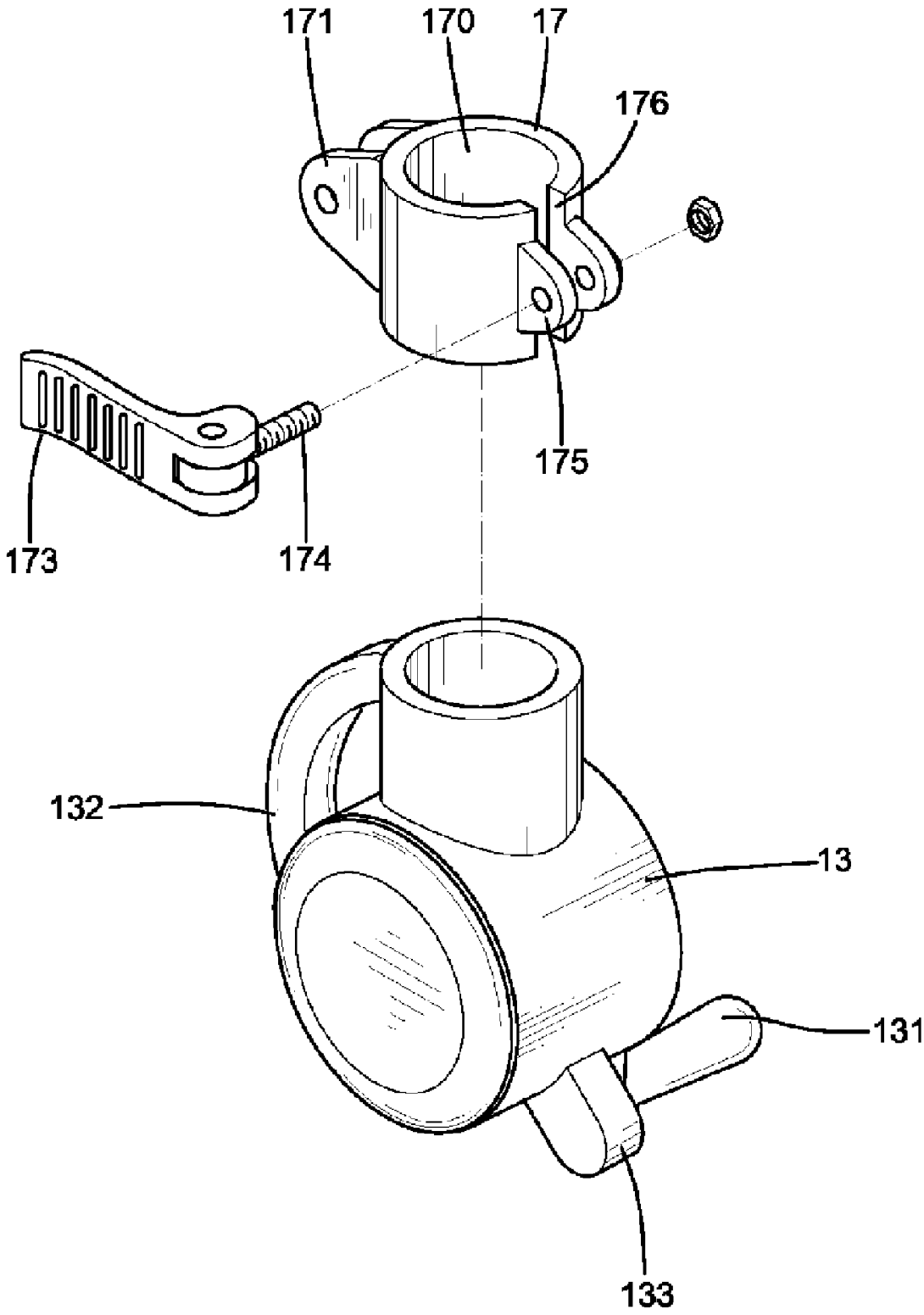
FIG. 5 is an exploded perspective view illustrating a second connecting member and a reel.
Figure 6:
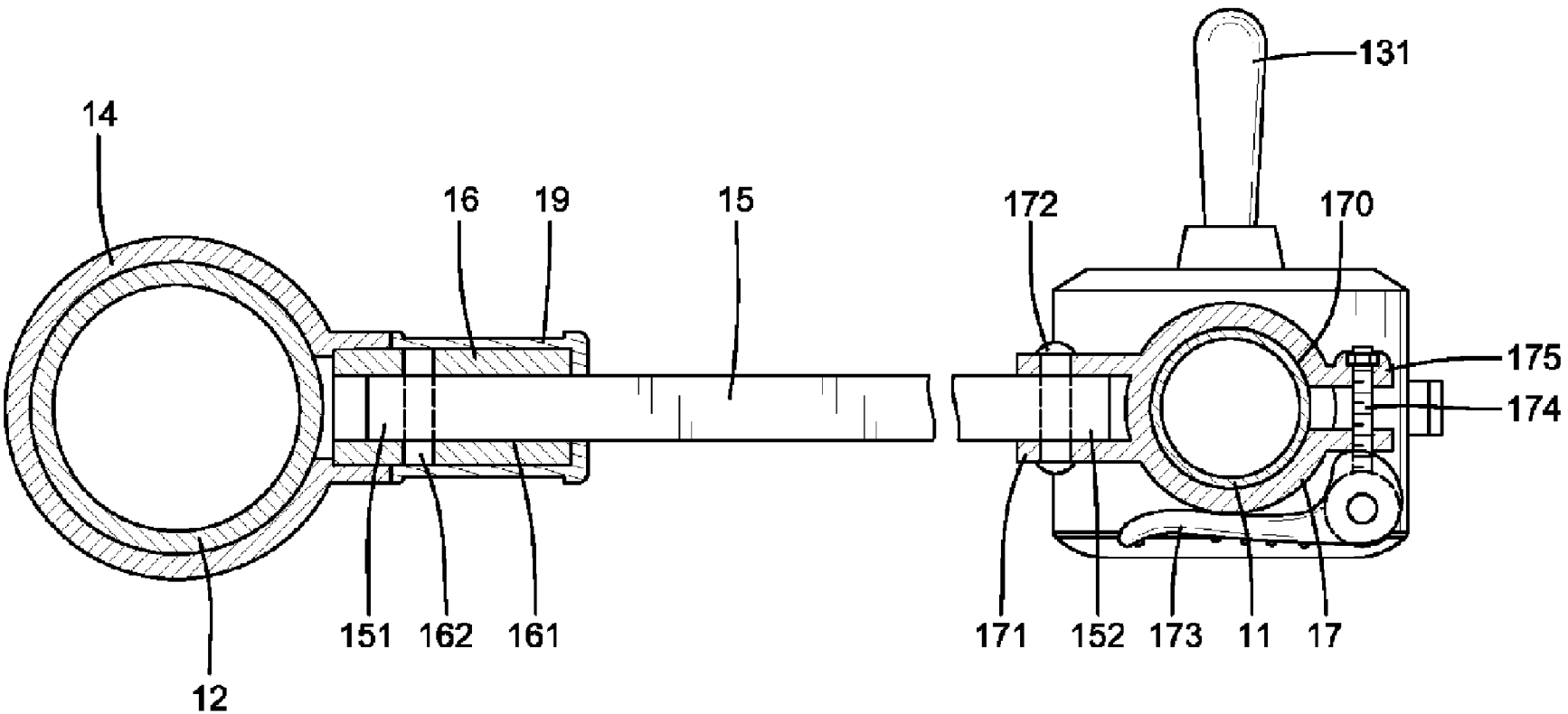
FIG. 6 is a sectional view taken along plane 6-6 in FIG. 3.

Referring to FIGS. 4 and 5, a second connecting member 17 is mounted to the second end of the arcuate tube 11. In this embodiment, the second connecting member 17 is a quick release including a substantially C-shaped body (not labeled) having a slit 176 in a circumference thereof. The body includes a longitudinal hole 170 so as to be mounted around the arcuate tube 11. Two lugs 175 are formed on two ends of the C-shaped body and include aligned holes (not labeled). A lever 173 includes a screw 174 pivotally connected to an end thereof. The screw 174 is extended through the aligned holes of the lugs 175 and then coupled with a nut (not labeled). Two ears 171 are formed on the circumference of the body and opposite to the slit 176. Referring to FIG. 6, a second end 152 of the connecting rod 15 is pivotally received in a space between the ears 171 by extending a pin 172 through aligned holes (not labeled) of the ears 171 and a hole (not labeled) in the second end 152 of the connecting rod 15. When the lever 173 is in a clamping position shown in FIG. 6, the second connecting member 17 is fixedly clamped on the arcuate tube 11 whereas the second end of the arcuate tube 11 is supported by the connecting rod 15. When the lever 173 is in a released position shown in FIG. 7, the second connecting member 17 is slidable along the arcuate tube 11 (or the arcuate tube 11 is slidable relative to the second connecting member 17).

Figure 7:
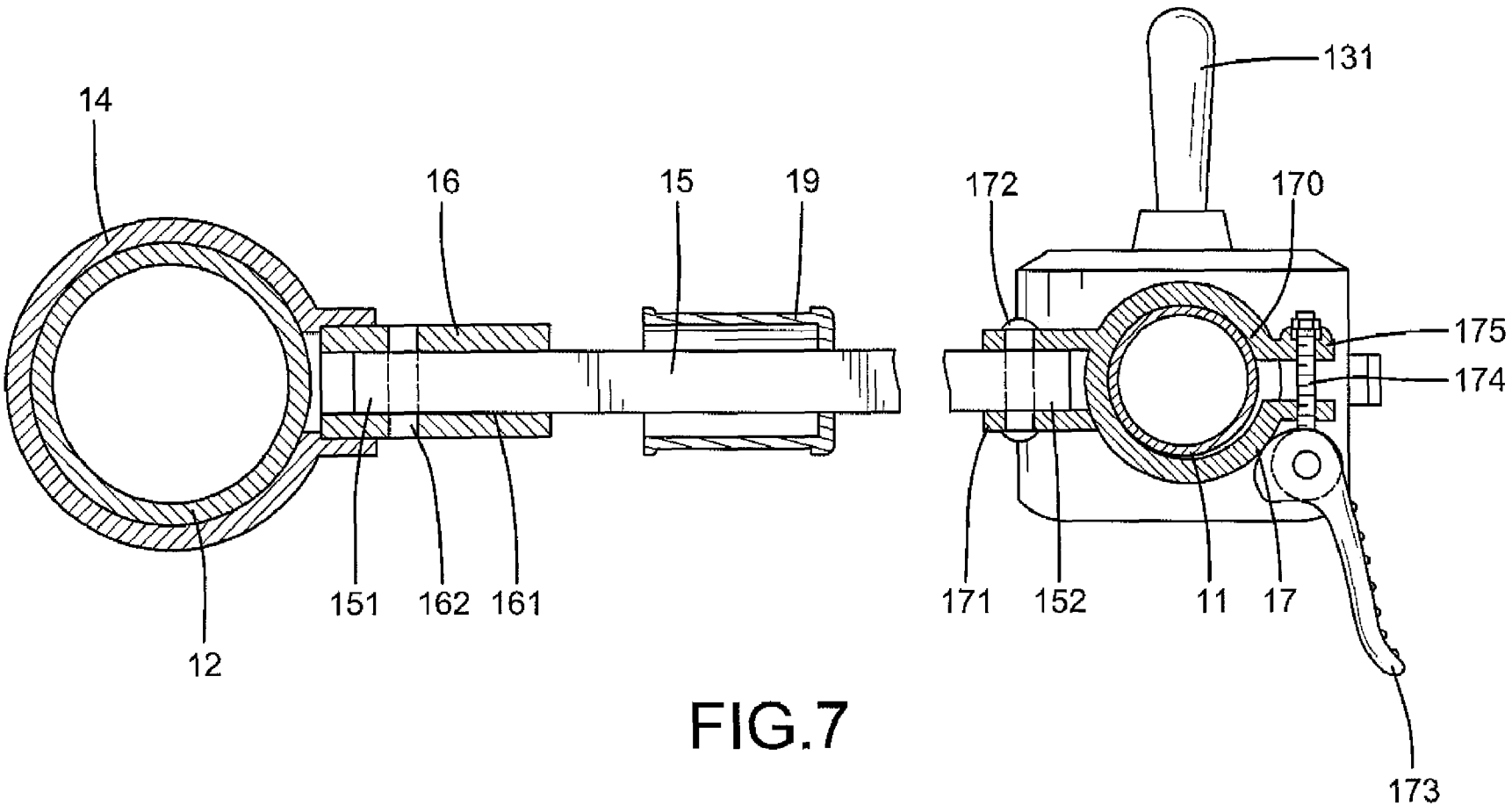
FIG. 7 is a view similar to FIG. 6, wherein the positioning member is disengaged from the first connecting member and wherein a lever of the second connecting member is in a released state.
Figure 8:
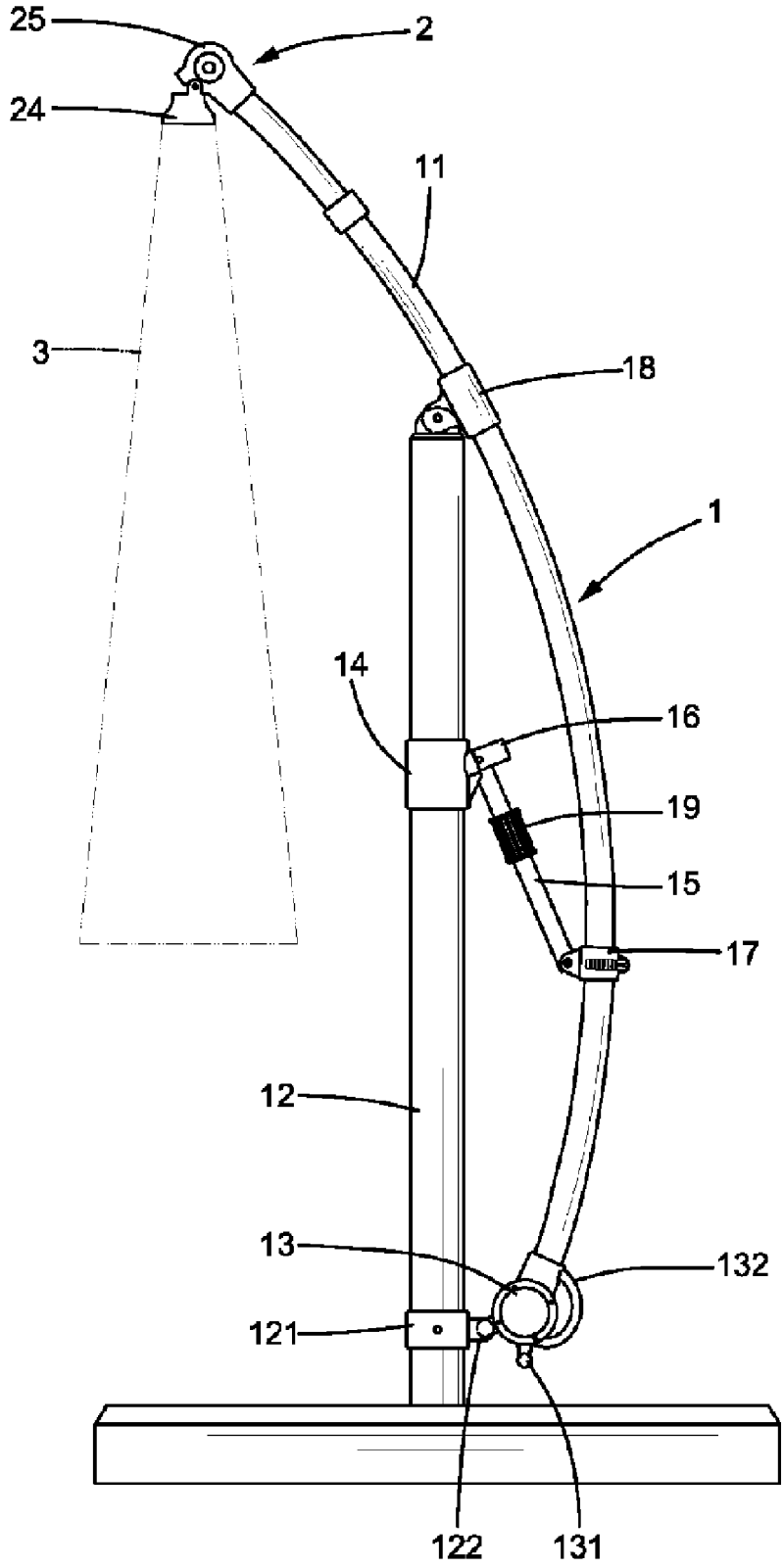
FIG. 8 is a side view similar to FIG. 2, wherein the sunshade is in a fully folded state.

Referring to FIGS. 7 and 8, in a case that the canopy 3 is folded, to further collapse the sunshade, the positioning member 19 is disengaged from the first connecting member 16 (i.e., the positioning member 19 is moved toward the second end 152 of the connecting rod 15), and the lever 173 is pivoted to the released position. A user may hold a gripping handle 132 on the reel 13 with only one hand and pull the arcuate tube 11 downward. The arcuate tube 11 will slide downward to a fully folded position (see FIG. 8), allowing easy carriage and transportation of the sunshade. Unfolding of the sunshade can be achieved through reverse operation. An easy-to-operate sunshade is, thus, provided.

Figure 9:
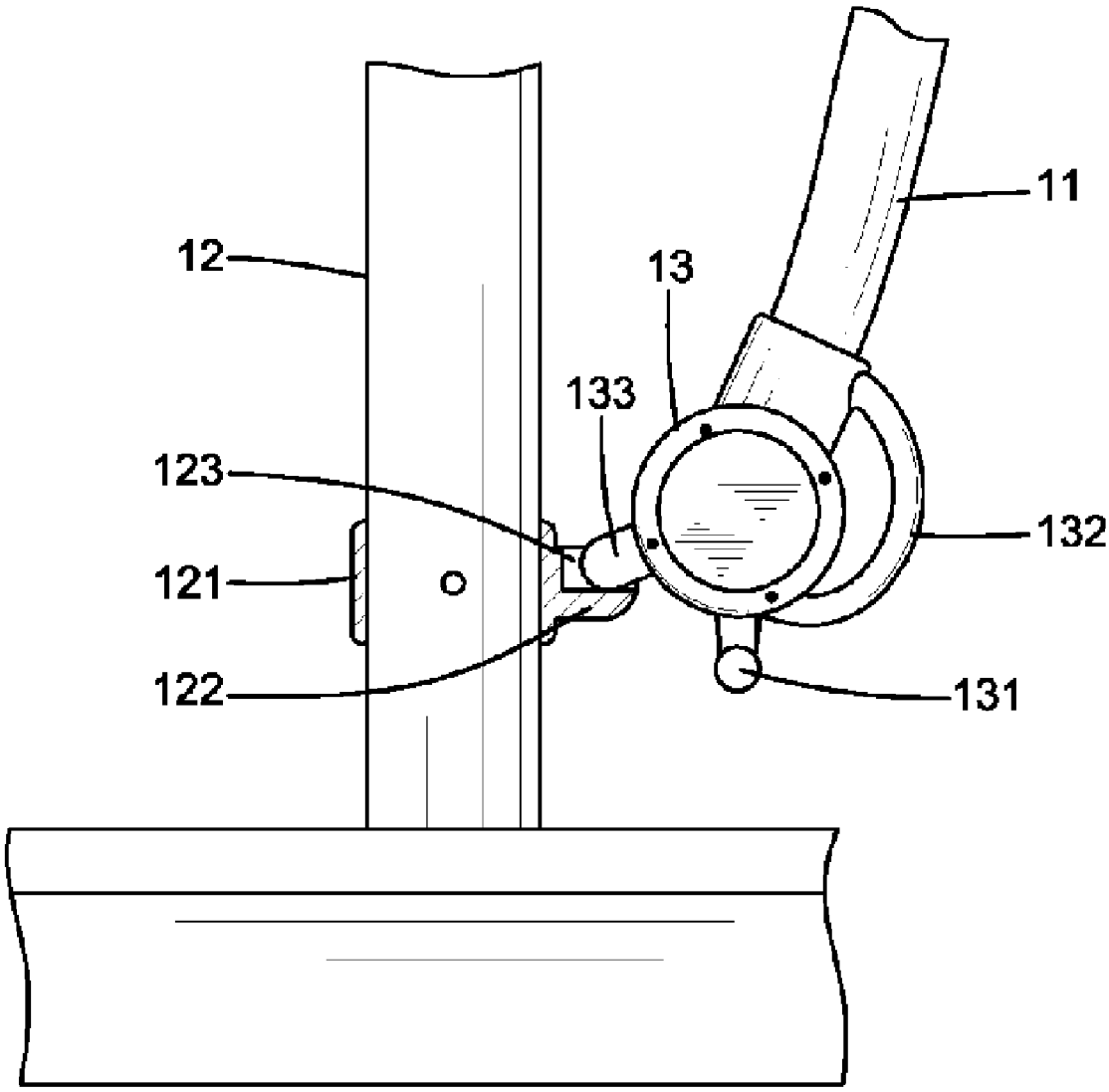
FIG. 9 is an enlarged view, partially sectioned, of a portion of the sunshade in FIG. 8.

Referring to FIGS. 8 and 9, the supporting rod 12 may include a coupling member 121. In this example, the coupling member 121 is a ring mounted around the supporting rod 12 and includes a protrusion 122 with a notch 123. When the arcuate tube 11 is in the fully folded position, a projection 133 on the reel 13 is engaged and, thus, retained in the notch 123 of the protrusion 122. Thus, the arcuate tube 11 is reliably retained in place when the sunshade is in the fully folded state.

If desired, the mounting sleeve 14 may be slidable relative to the supporting rod 12 to allow adjustment of the tilting angle of the canopy 3, such as the arrangement disclosed in U.S. Pat. No. 6,152,156. Further, the supporting rod 12 and the arcuate tube 11 may include two or more sections telescopically received one in another.

Although a specific embodiment has been illustrated and described, numerous modifications and variations are still possible. The scope of the invention is limited by the accompanying claims.

What is claimed is:

1. A sunshade comprising:

a supporting rod having an upper end;

a holding sleeve pivotably mounted to the upper end of the supporting rod;

an arcuate tube slidably extended through the holding sleeve, with the arcuate tube including a first end adapted for coupling with a canopy support frame and including a second end;

a reel mounted to the second end of the arcuate tube, with the reel including a projection;

a coupling member mounted to the supporting rod and including a notch, with the projection being releasably engaged with the notch when the arcuate tube is in a folded position;

a first connecting member mounted to the supporting rod;

a second connecting member including a body mounted around the second end of the arcuate tube, with the second connecting member further including a lever pivotally coupled to the body, with the lever being movable between a clamping position and a released position;

a connecting rod including a first end pivotally connected to the first connecting member and a second end pivotally connected to the second connecting member; and a positioning member releasably engaged with the first connecting member for positioning the connecting rod in place, with the connecting rod being pivotable relative to the first connecting member when the positioning member is disengaged from the first connecting member;

wherein when the lever is in the clamping position, the second connecting member is fixed on the arcuate tube, and the second end of the arcuate tube is supported by the connecting rod; and wherein when the lever is in the released position, relative sliding movement between the second connecting member and the arcuate tube is allowed.

2. The sunshade as claimed in claim 1 further comprising a mounting sleeve mounted around the supporting rod, and wherein the first connecting member extends from the mounting sleeve.

3. The sunshade as claimed in claim 2 wherein the first connecting member includes a slot for pivotally receiving the first end of the connecting rod.

4. The sunshade as claimed in claim 1 wherein the positioning member is a sleeve slidably mounted on the connecting rod between a first position engaged with the first connecting member and a second position disengaged from the first connecting member.

5. The sunshade as claimed in claim 1 wherein the second connecting member includes two ears between which the second end of the connecting rod is pivotally mounted.

6. The sunshade as claimed in claim 1 wherein the body is substantially C-shaped and includes a slit, with the body further including two spaced lugs, with the lever including a screw pivotally connected to an end thereof, and with the screw extending through the lugs, allowing the lever to pivot between the clamping position and the released position.

7. The sunshade as claimed in claim 1 wherein the reel includes a gripping handle.

8. The sunshade as claimed in claim 1 wherein the coupling member includes a ring mounted around the supporting rod, with the ring including a protrusion in which the notch is defined.

9. A sunshade comprising:

a supporting rod having an upper end;

a holding sleeve pivotably mounted to the upper end of the supporting rod;

an arcuate tube slidably extended through the holding sleeve, with the arcuate tube including a first end adapted for coupling with a canopy support frame and a second end;

a reel mounted to the second end of the arcuate tube, with the reel including a projection;

a coupling member mounted to the supporting rod and including a notch, with the projection being releasably engaged with the notch when the arcuate tube is in a folded position;

a mounting member mounted to the supporting rod;

a quick release mounted around the second end of the arcuate tube; and a connecting rod including a first end pivotally connected to the mounting member and a second end pivotally connected to the quick release;

wherein when the quick release is in a clamping position, the quick release is fixedly clamped on the arcuate tube, and the second end of the arcuate tube is supported by the connecting rod;

wherein when the quick release is in a released position, relative sliding movement between the quick release and the arcuate tube is allowed.

10. The sunshade as claimed in claim 9 further comprising a positioning member releasably engaged with the mounting member for positioning the connecting rod in place, with the connecting rod being pivotable relative to the mounting member when the positioning member is disengaged from the mounting member.

11. The sunshade as claimed in claim 10 wherein the positioning member is slidably mounted on the connecting rod between a first position engaged with the mounting member and a second position disengaged from the mounting member.

12. The sunshade as claimed in claim 9 wherein the reel includes a gripping handle.

13. The sunshade as claimed in claim 9 wherein the coupling member includes a ring mounted around the supporting rod, with the ring including a protrusion in which the notch is defined.

* * * * *